US012638271B2

(12) United States Patent
Teetzel et al.

(10) Patent No.: US 12,638,271 B2
(45) Date of Patent: May 26, 2026

(54) WEAPON ACCESSORY RISER AND INTEGRAL KEYPAD FOR WEAPON HANDGUARD

(71) Applicant: WILCOX INDUSTRIES CORP., Newington, NH (US)

(72) Inventors: James W. Teetzel, Portsmouth, NH (US); Joshua R. Beaulieu, Sanbornville, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 19/009,241

(22) Filed: Jan. 3, 2025

(65) Prior Publication Data

US 2025/0231009 A1 Jul. 17, 2025

Related U.S. Application Data

(60) Provisional application No. 63/621,674, filed on Jan. 17, 2024.

(51) Int. Cl.
*F41G 11/00* (2006.01)

(52) U.S. Cl.
CPC ..... *F41G 11/001* (2013.01)

(58) Field of Classification Search
CPC ..... F41G 11/001
See application file for complete search history.

(56) References Cited

U.S. PATENT DOCUMENTS

| | | | | |
|---|---|---|---|---|
| 7,866,083 | B2 * | 1/2011 | Teetzel | F41G 1/35 42/117 |
| 7,975,419 | B2 * | 7/2011 | Darian | F41C 27/00 42/84 |
| 8,091,265 | B1 * | 1/2012 | Teetzel | F41C 23/16 42/71.01 |
| 8,104,211 | B2 * | 1/2012 | Darian | F41C 27/00 42/84 |
| 8,220,946 | B1 * | 7/2012 | Teetzel | F41G 11/003 89/200 |

(Continued)

OTHER PUBLICATIONS

Extended European Search Report dated Jun. 17, 2025, received in European Patent Application No. 25150289.4 (6 pages).

*Primary Examiner* — Michelle Clement
(74) *Attorney, Agent, or Firm* — McLane Middleton, Professional Association

(57) ABSTRACT

A weapon attachment riser system for a weapon includes a riser assembly including a base housing, which defines an interior compartment, and a housing cover secured to the base housing. The base housing is configured to be detachably secured to a powered weapon accessory interface on the weapon and the housing cover is configured to be detachably secured to an accessory device. A circuit assembly includes a flexible circuit substrate disposed within the interior compartment. The circuit assembly includes a first electrical connector configured to detachably engage a complementary weapon rail interface port on the powered weapon accessory interface through an aligned opening in the housing base and a second electrical connector configured to detachably engage a complementary accessory interface port on the accessory device through an aligned opening in the housing cover.

17 Claims, 19 Drawing Sheets

(56) References Cited

U.S. PATENT DOCUMENTS 8,490,313 B2 * 7/2013 Frascati ..... F41G 11/003 42/72
8,769,856 B2 * 7/2014 Berntsen ..... F41C 23/16 42/84
8,915,008 B2 * 12/2014 Mauricio ..... F41G 3/326 42/111
9,200,867 B1 * 12/2015 Swan ..... F41C 23/16
9,279,639 B2 * 3/2016 Hines ..... F41C 23/22
10,001,344 B1 6/2018 Alford et al.
10,337,836 B2 * 7/2019 Righi ..... F41G 11/003
10,477,618 B2 * 11/2019 Downing ..... F41G 9/00
10,551,149 B2 * 2/2020 Teetzel ..... F41G 11/003
10,557,687 B2 * 2/2020 Teetzel ..... F41G 1/34
10,753,709 B2 * 8/2020 Neal ..... G02B 6/4206
10,976,131 B1 * 4/2021 Cabahug ..... F41C 23/16
11,060,820 B2 * 7/2021 Zimmer ..... F41G 11/003
11,067,367 B2 * 7/2021 Delgado Acarreta ... H04L 67/61
11,162,763 B2 * 11/2021 Masarik ..... F41G 11/003
2008/0134562 A1 * 6/2008 Teetzel ..... F41G 1/35 42/114
2010/0031552 A1 * 2/2010 Houde-Walter ..... F41C 23/16 42/72
2010/0192444 A1 * 8/2010 Cabahug ..... F41G 11/003 42/71.01
2010/0192446 A1 * 8/2010 Darian ..... F41G 11/003 320/108
2011/0000120 A1 * 1/2011 Thompson ..... F41C 27/00 42/84
2011/0010979 A1 * 1/2011 Houde-Walter ..... F41G 11/003 42/84
2011/0173865 A1 * 7/2011 Compton ..... F41C 27/00 42/84
2012/0180363 A1 7/2012 Frascati et al.
2012/0180364 A1 * 7/2012 Berntsen ..... F41C 23/16 42/90
2012/0192476 A1 * 8/2012 Compton ..... F41G 11/003 42/84
2012/0285064 A1 * 11/2012 Houde-Walter ..... F41A 35/00 42/72
2013/0185978 A1 * 7/2013 Dodd ..... F41G 11/003 42/84
2014/0007485 A1 * 1/2014 Castejon, Sr. ..... F41G 1/35 42/117
2014/0047754 A1 * 2/2014 Compton ..... F41G 11/00 42/84
2015/0020427 A1 * 1/2015 Compton ..... F41A 35/00 42/71.01
2015/0241166 A1 * 8/2015 Hines ..... F41G 11/003 42/75.02
2015/0300786 A1 * 10/2015 Downing ..... F41G 3/04 235/404
2016/0018185 A1 * 1/2016 Makohon ..... F41C 27/00 42/90
2016/0061560 A1 * 3/2016 Saadon ..... F41G 1/35 42/72
2016/0327371 A1 * 11/2016 Teetzel ..... F41C 23/16
2017/0010073 A1 * 1/2017 Downing ..... F41C 27/00
2017/0205202 A1 * 7/2017 Teetzel ..... F41G 11/003
2018/0328698 A1 * 11/2018 Miller ..... F41C 23/22
2018/0364008 A1 * 12/2018 Summerfield ..... F41G 1/44
2019/0049221 A1 * 2/2019 Zimmer ..... F41G 11/003
2019/0107370 A1 * 4/2019 Galli ..... F41G 11/003
2019/0249958 A1 * 8/2019 Teetzel ..... F41G 3/12
2019/0310051 A1 * 10/2019 Cabahug ..... F41C 27/00
2019/0353462 A1 * 11/2019 Neal ..... G02B 6/4206
2020/0033096 A1 * 1/2020 Sabaldan Elpedes .... F41G 1/35
2020/0124383 A1 * 4/2020 Miller ..... F41J 5/10
2020/0232737 A1 * 7/2020 Mcclellan ..... F41G 3/06
2021/0140742 A1 * 5/2021 Neal ..... G02B 6/4206
2021/0341258 A1 * 11/2021 Galli ..... H05B 45/00
2021/0372737 A1 * 12/2021 Masarik ..... F41G 3/06
2023/0168068 A1 * 6/2023 Fackler ..... F41G 11/003 42/124
2024/0302136 A1 * 9/2024 Teetzel ..... F41G 1/38
2025/0085080 A1 * 3/2025 Teetzel ..... F41C 27/00
2025/0231009 A1 * 7/2025 Teetzel ..... F41G 11/001
2025/0283696 A1 * 9/2025 Teetzel ..... F41G 11/001
2025/0290727 A1 * 9/2025 Teetzel ..... F41G 1/473

* cited by examiner

WEAPON ACCESSORY RISER AND INTEGRAL KEYPAD FOR WEAPON HANDGUARD

CROSS REFERENCE TO RELATED APPLICATION

This application claims the priority benefit of U.S. provisional application No. 63/621,674 filed Jan. 17, 2024. The aforementioned application is incorporated herein by reference in its entirety.

BACKGROUND

In one aspect, the present development relates to a riser for lifting an accessory such as a fire control system higher above a weapon. In another aspect, the present development relates to a keypad that is integral to a handguard of the weapon for controlling operation of the accessory.

SUMMARY

A weapon attachment riser system for a weapon includes a riser assembly including a base housing, which defines an interior compartment, and a housing cover secured to the base housing. The base housing is configured to be detachably secured to a powered weapon accessory interface on the weapon and the housing cover is configured to be detachably secured to an accessory device. A circuit assembly includes a flexible circuit substrate disposed within the interior compartment. The circuit assembly includes a first electrical connector configured to detachably engage a complementary weapon rail interface port on the powered weapon accessory interface through an aligned opening in the housing base and a second electrical connector configured to detachably engage a complementary accessory interface port on the accessory device through an aligned opening in the housing cover.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention, which may be embodied in various forms. Therefore, specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention and are not intended to limit the structure thereof to any particular position or orientation.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Figure 1:
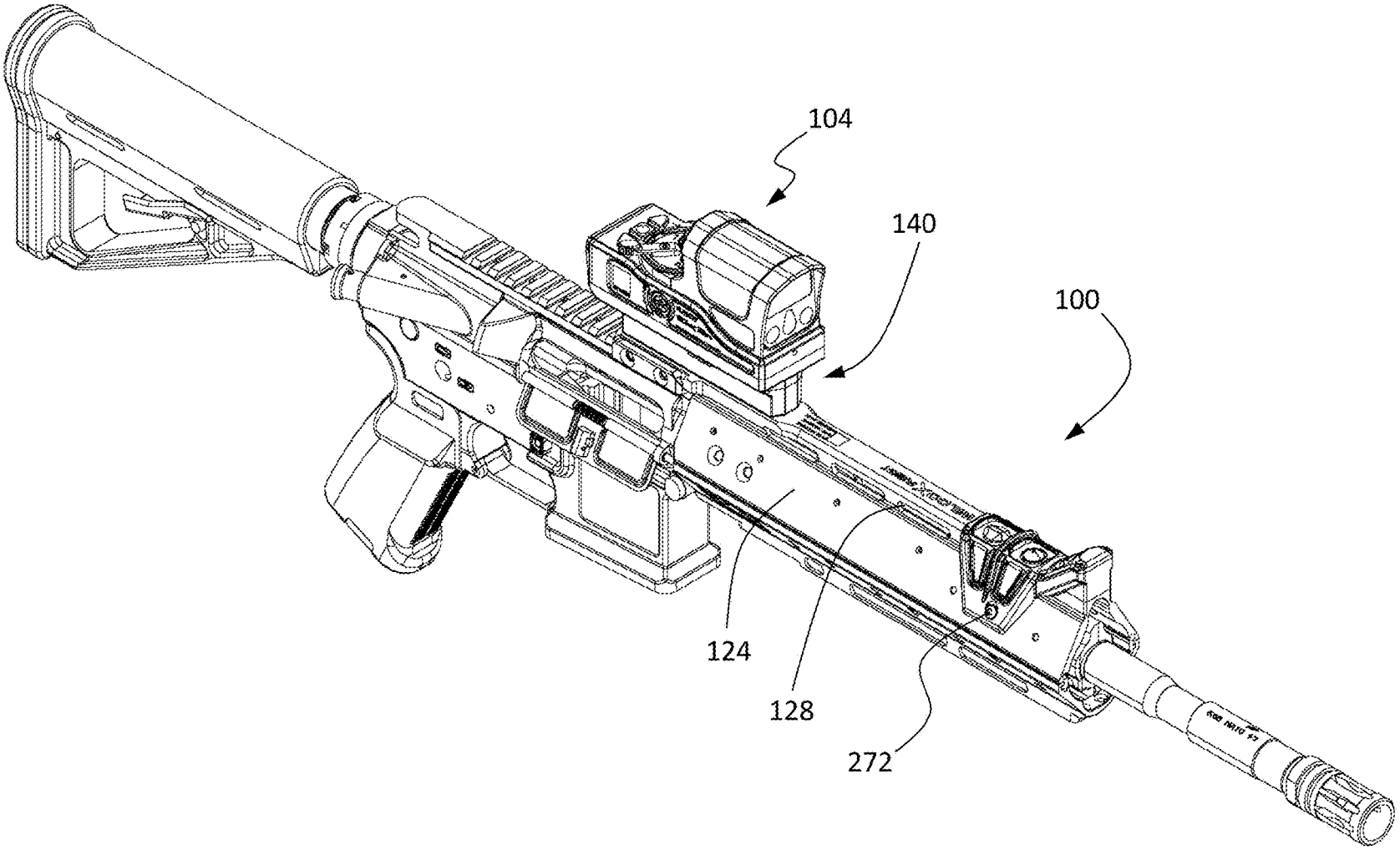
FIG. 1 is a first isometric view of a weapon having an exemplary riser assembly and keypad assembly thereon.
Figure 2:
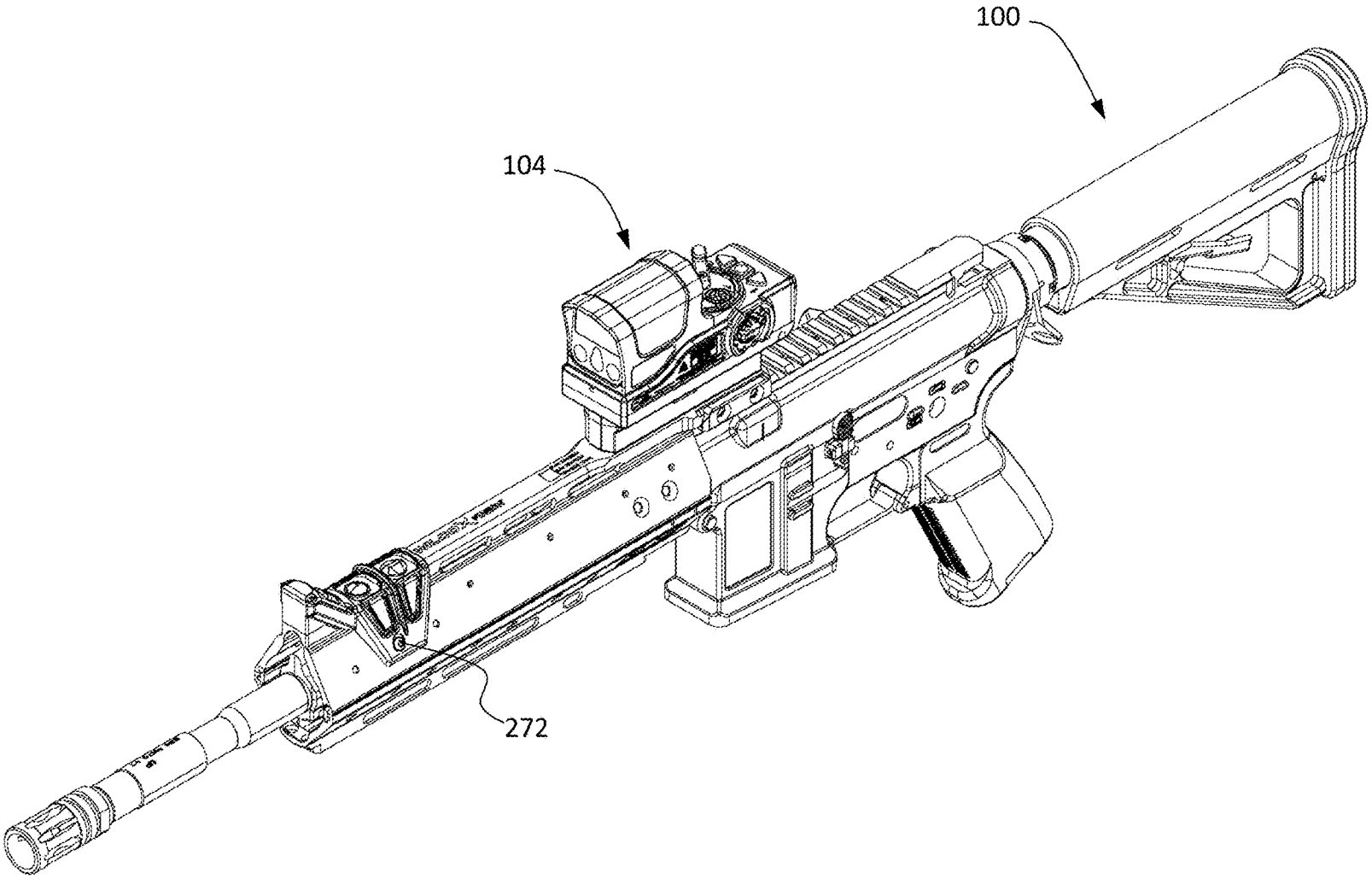
FIG. 2 is a second isometric view of the weapon with the riser assembly and keypad assembly appearing in FIG. 1.
Figure 3:
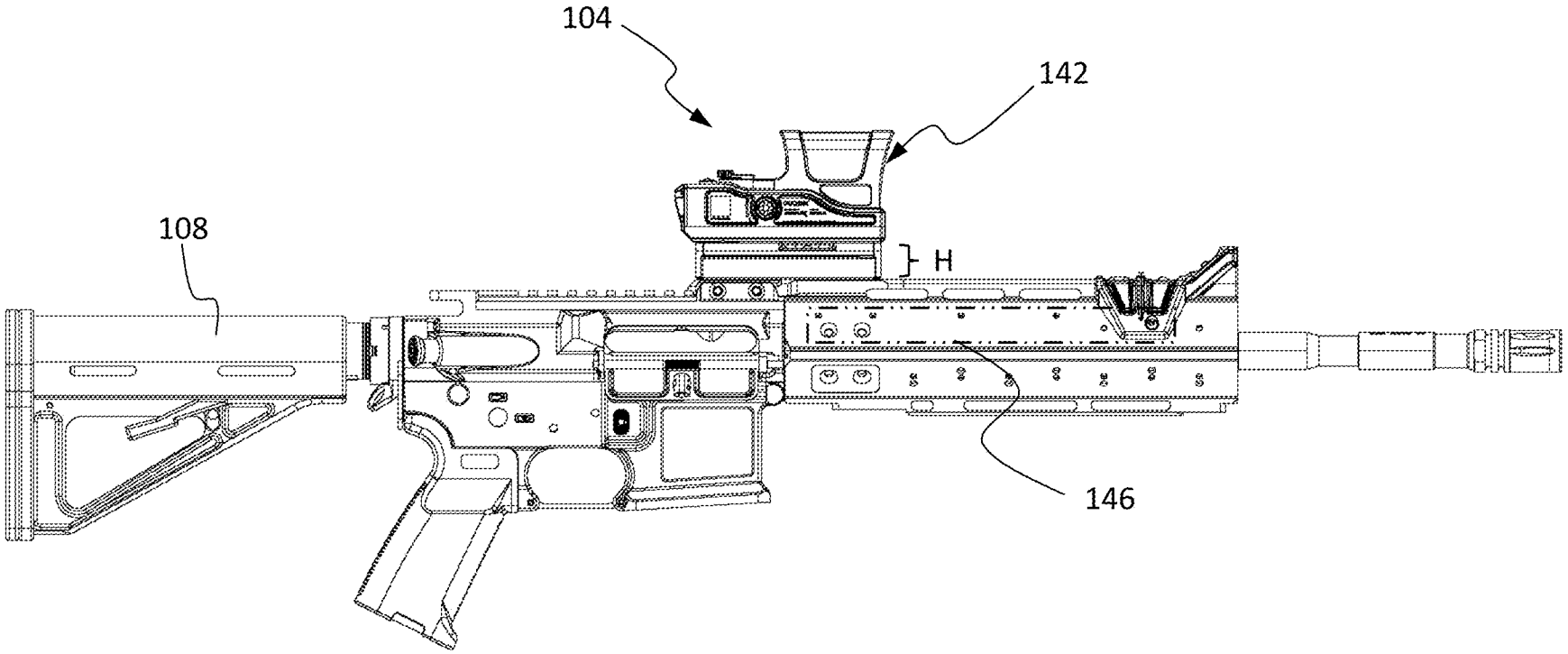
FIG. 3 is a first side elevational view of the weapon with the riser assembly and keypad assembly appearing in FIG. 1.
Figure 4:
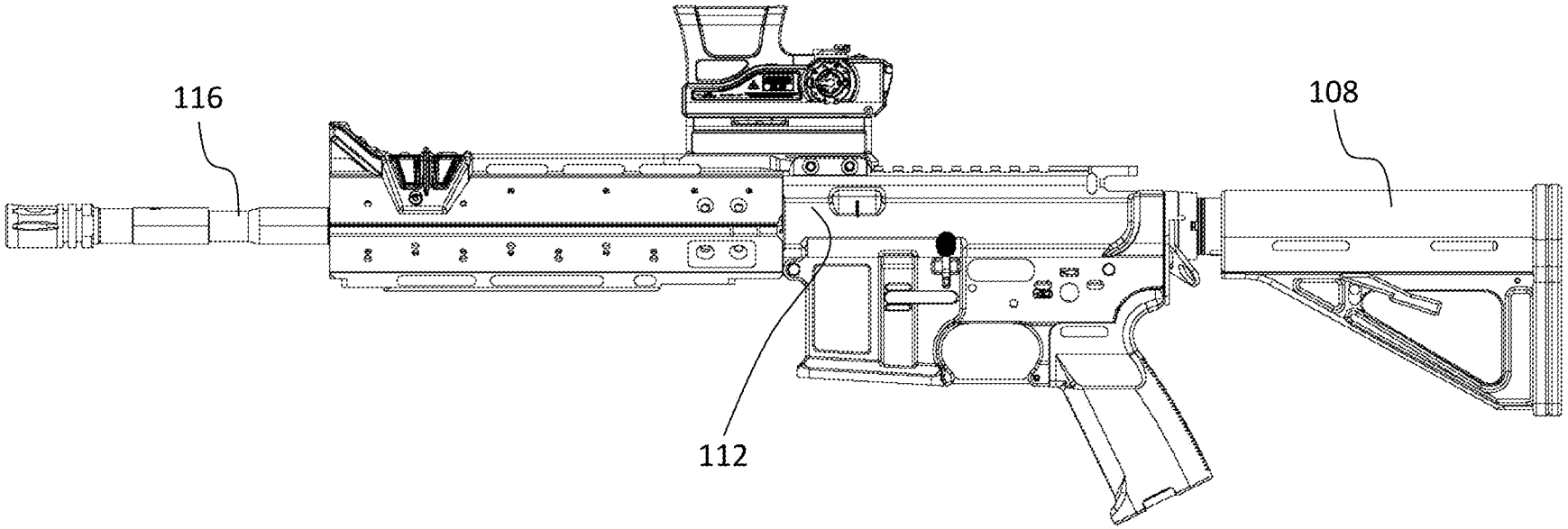
FIG. 4 is a second side elevational view of the weapon with the riser assembly and keypad assembly appearing in FIG. 1.
Figure 5:
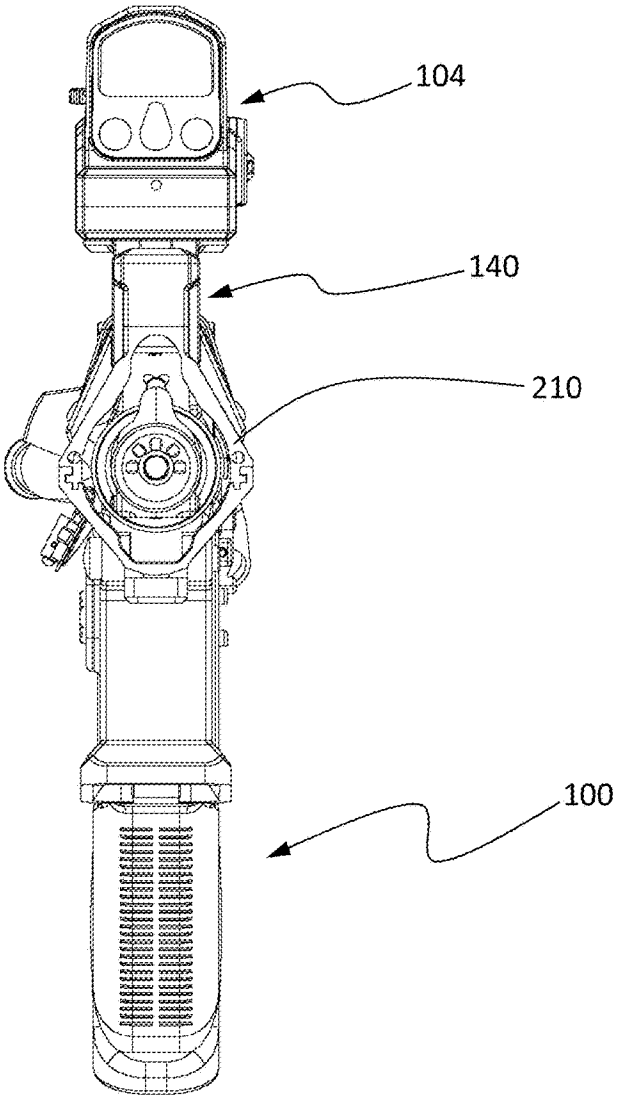
FIG. 5 is a front elevational view of the weapon with the riser assembly and keypad assembly appearing in FIG. 1.
Figure 6:
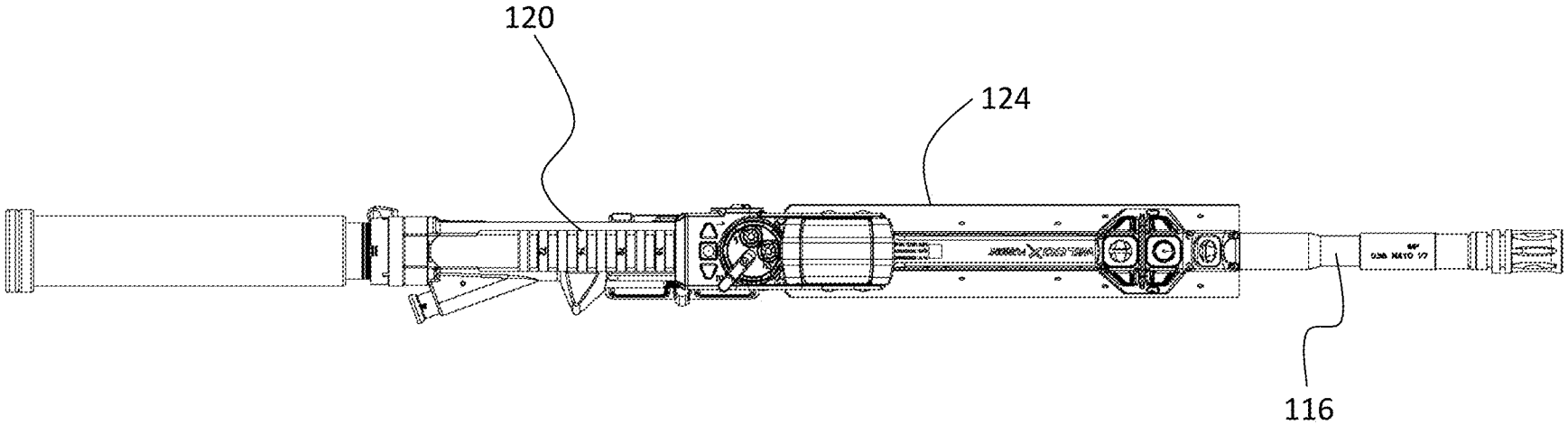
FIG. 6 is a top plan view of the weapon with the riser assembly and keypad assembly appearing in FIG. 1.
Figure 7:
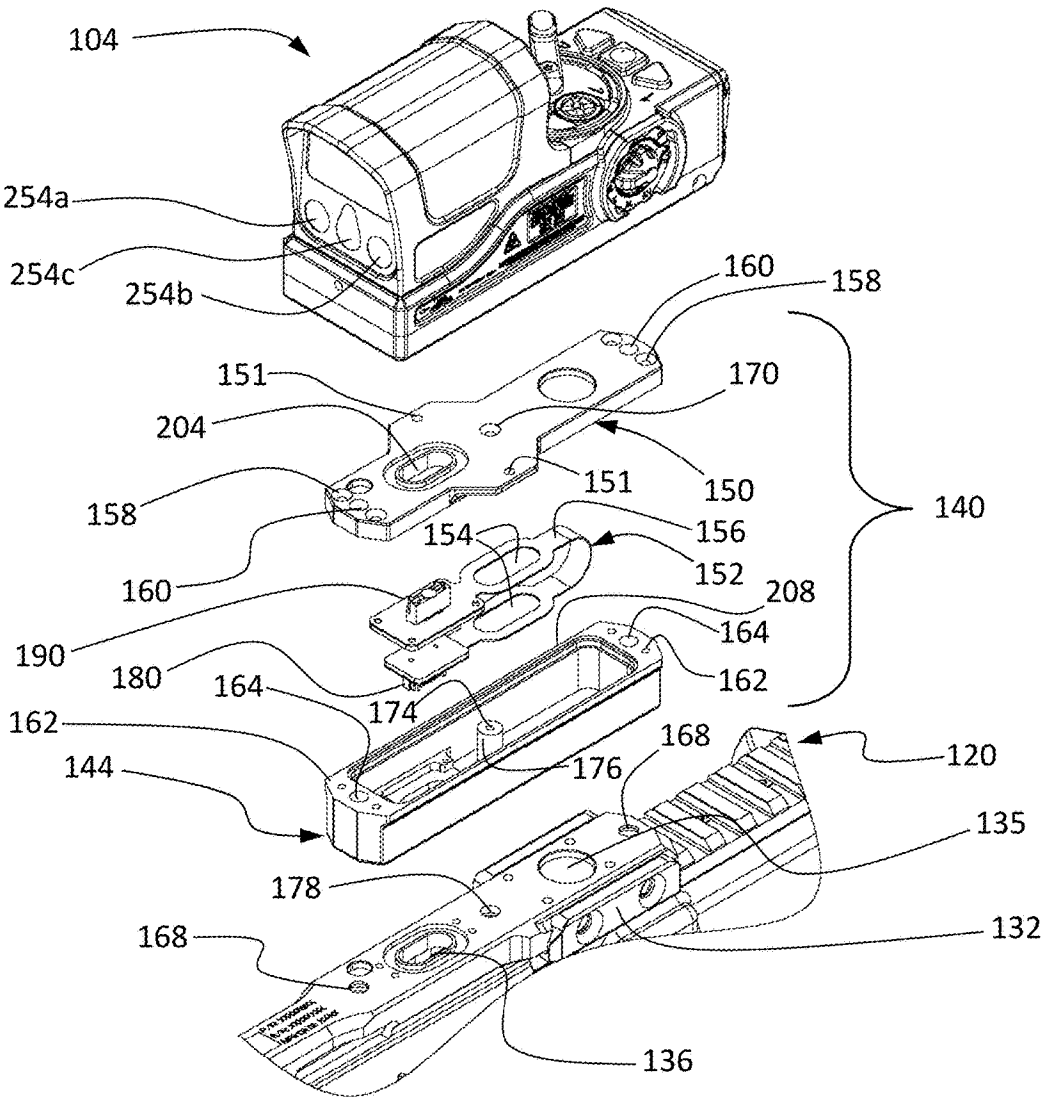
FIG. 7 is an enlarged exploded isometric view of the riser assembly appearing in FIG. 1.
Figure 8:
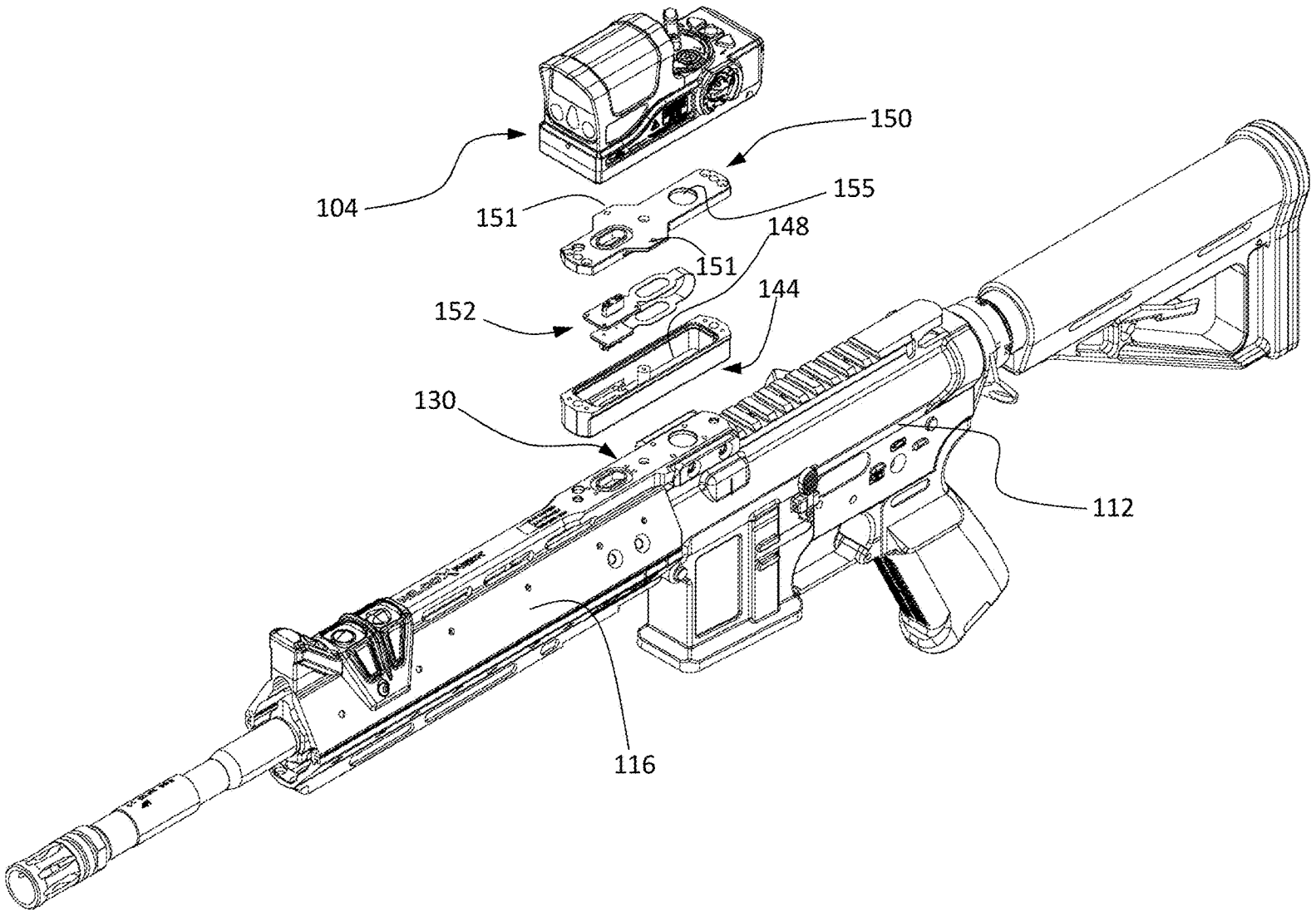
FIG. 8 is a first isometric view of the weapon with the riser assembly and keypad assembly appearing in FIG. 1 with the riser assembly in exploded view.
Figure 9:
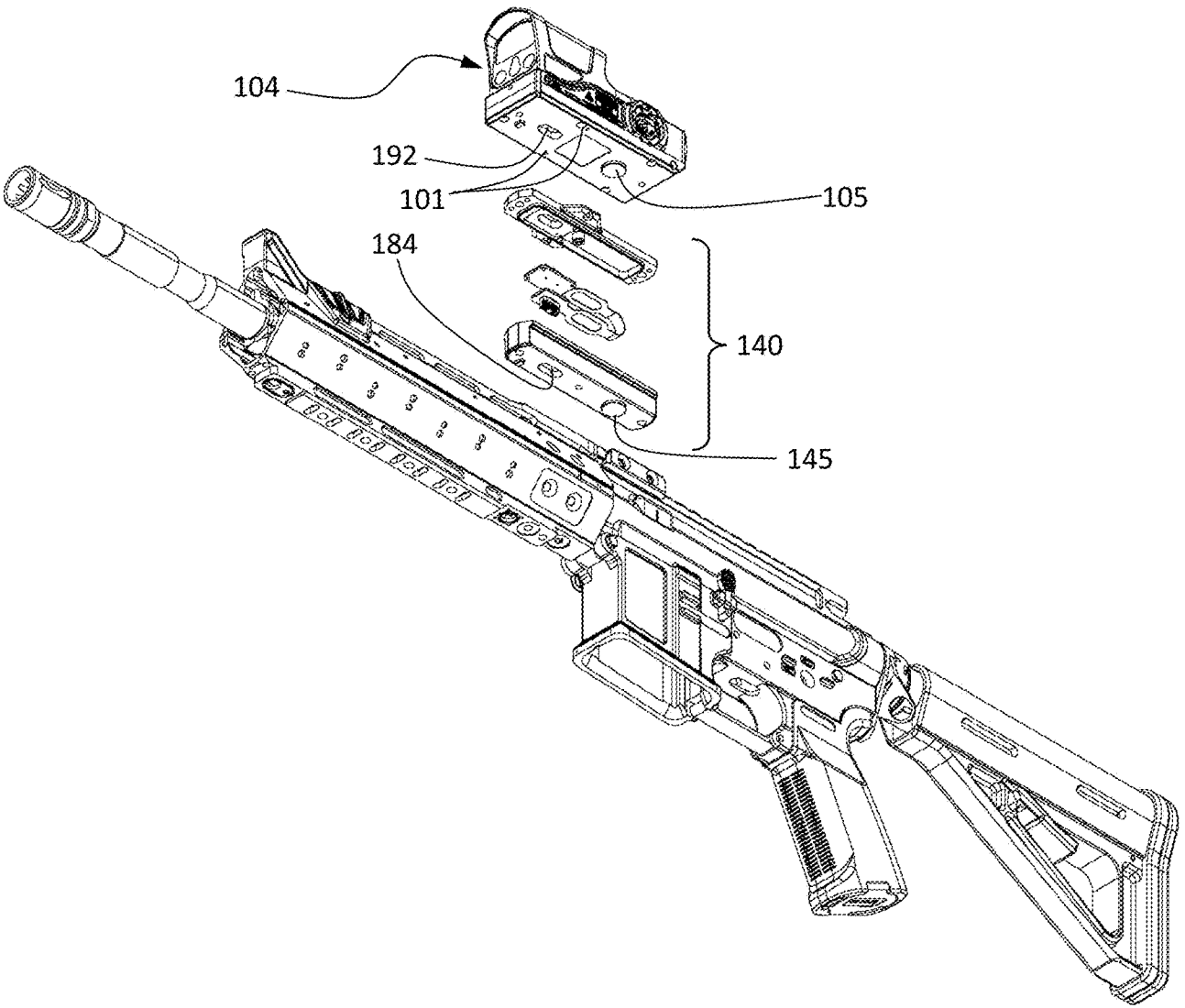
FIG. 9 is a second isometric view of the weapon with the riser assembly and keypad assembly appearing in FIG. 1 with the riser assembly in exploded view.
Figure 10:
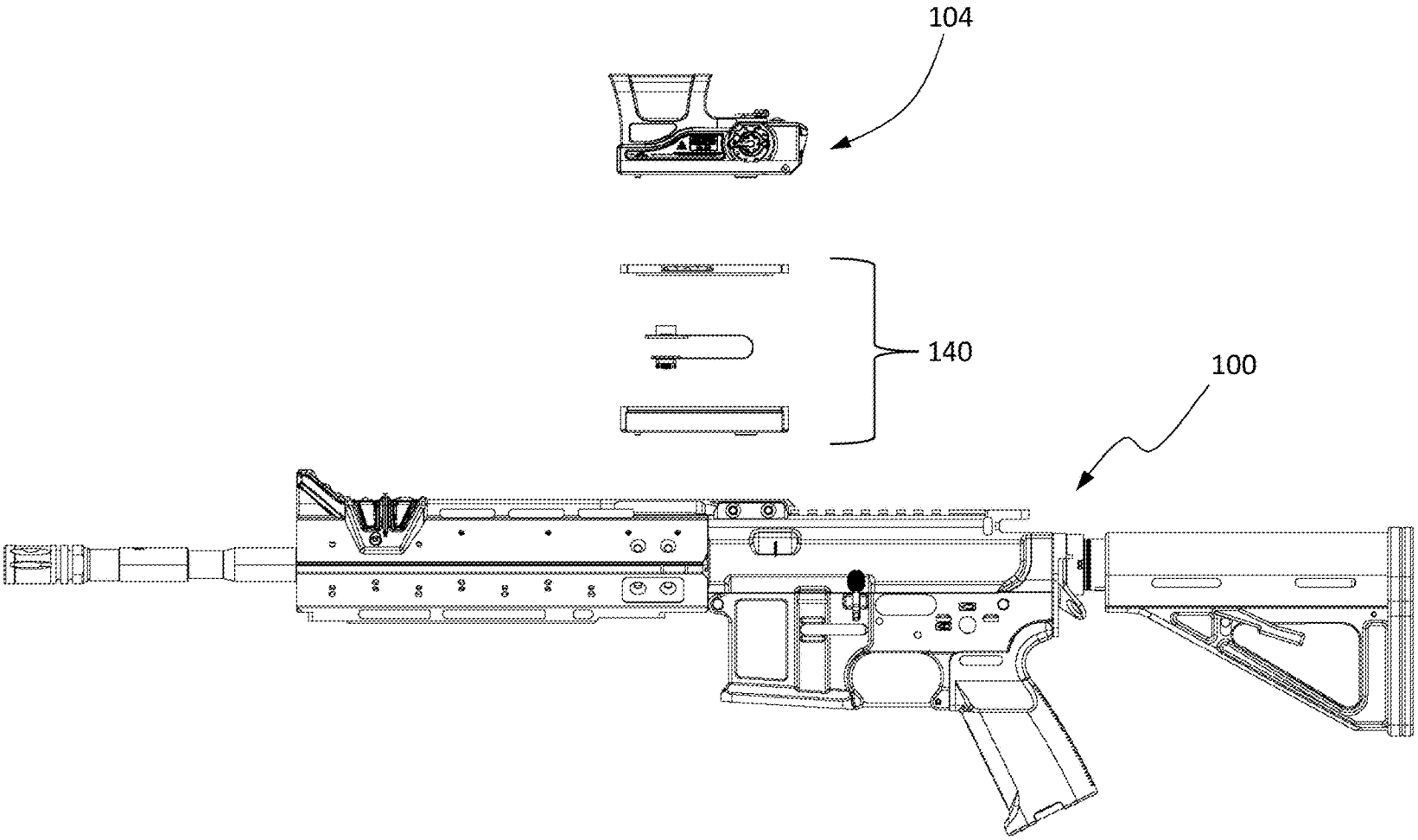
FIG. 10 is a side elevational view of the weapon with the riser assembly and keypad assembly appearing in FIG. 1 with the riser assembly in exploded view.
Figure 11:
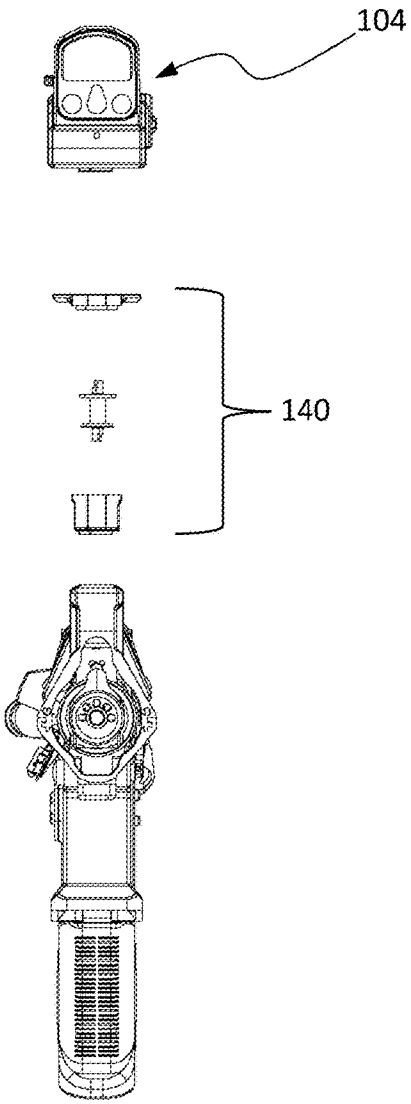
FIG. 11 is a front elevational view of the weapon with the riser assembly and keypad assembly appearing in FIG. 1 with the riser assembly in exploded view.
Figure 12:
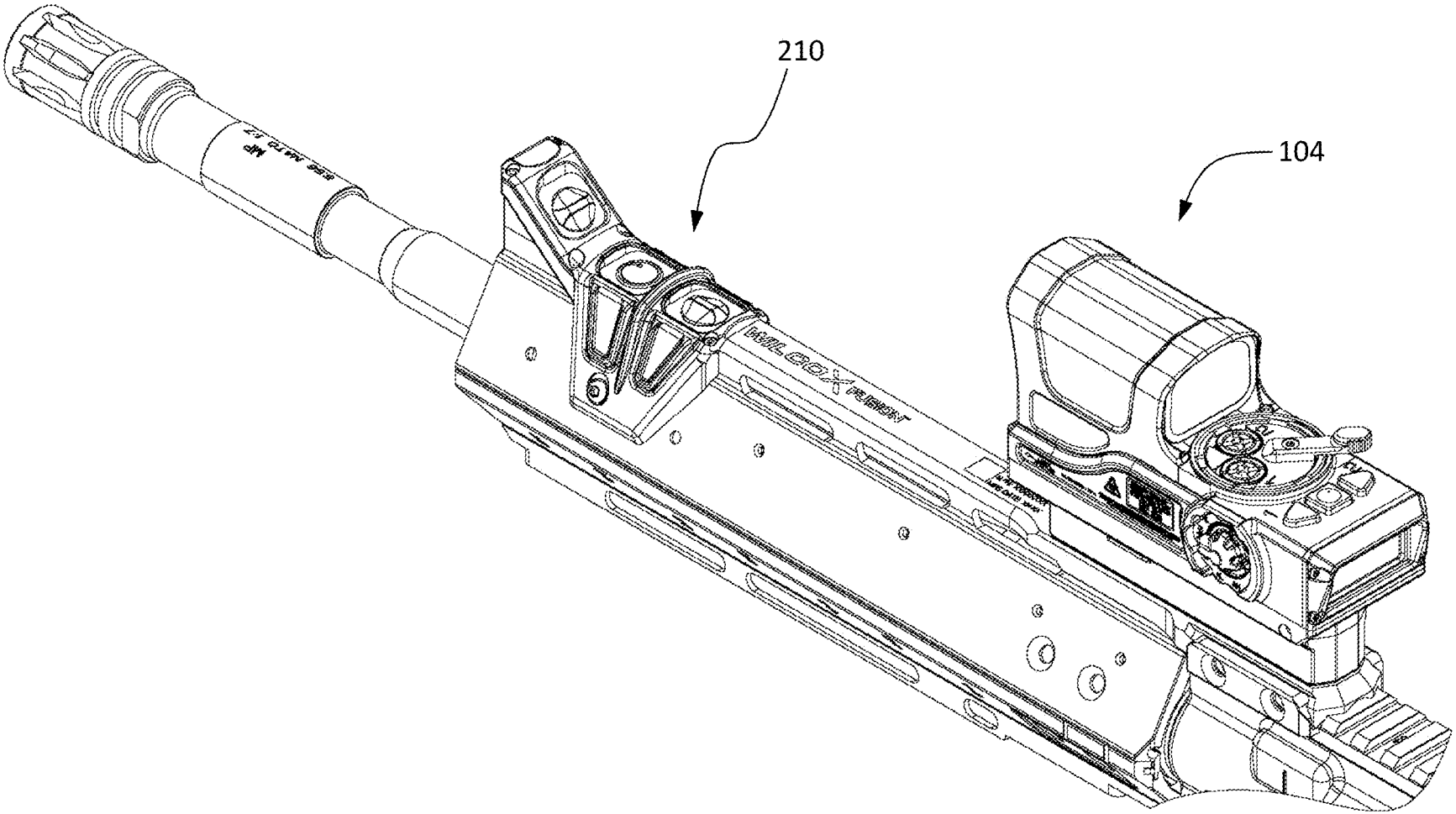
FIG. 12 is an enlarged fragmentary isometric view of the weapon with the riser assembly and keypad assembly appearing in FIG. 1.
Figure 13:
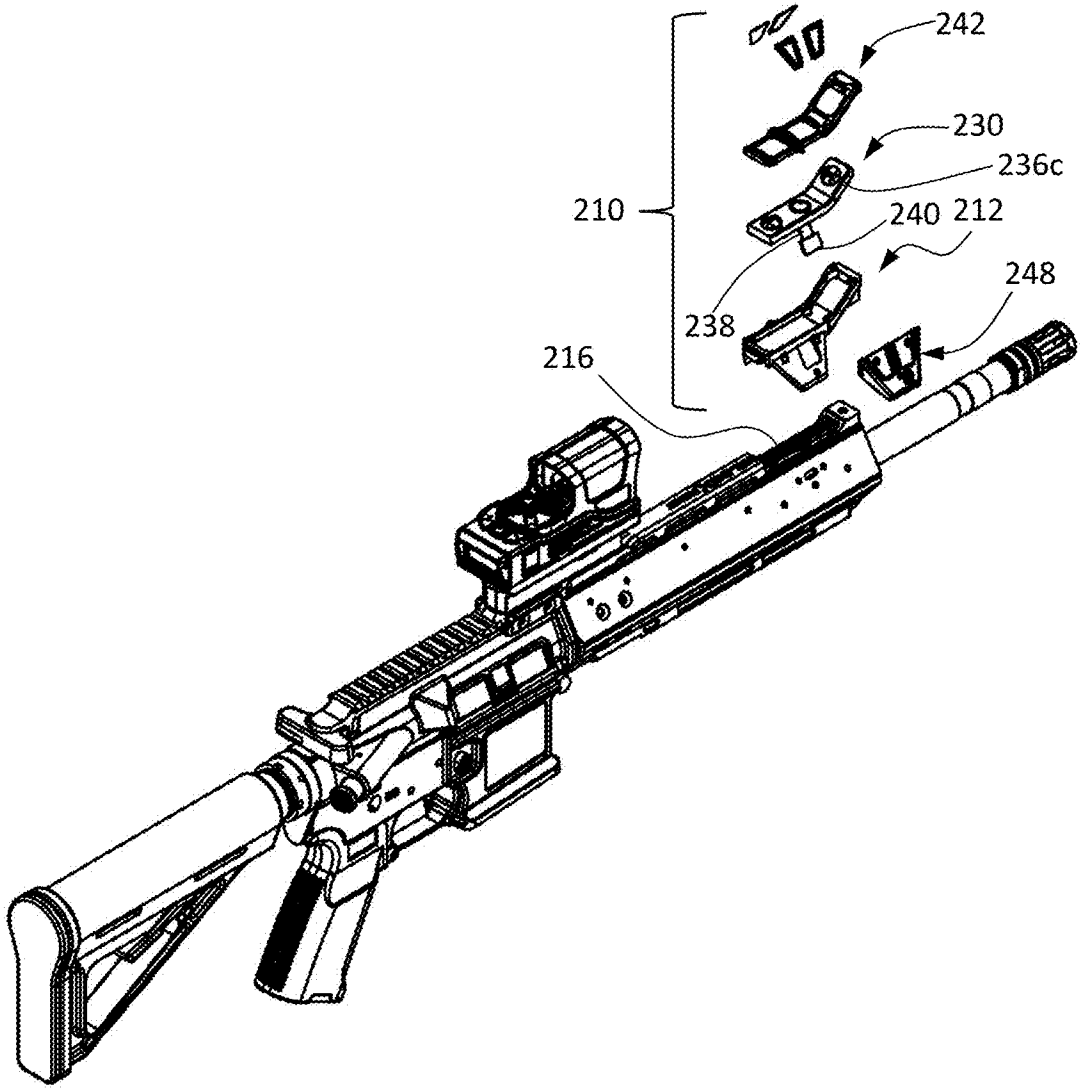
FIG. 13 is a first isometric view of the weapon with the riser assembly and keypad assembly appearing in FIG. 1 with the keypad assembly in exploded view.
Figure 14:
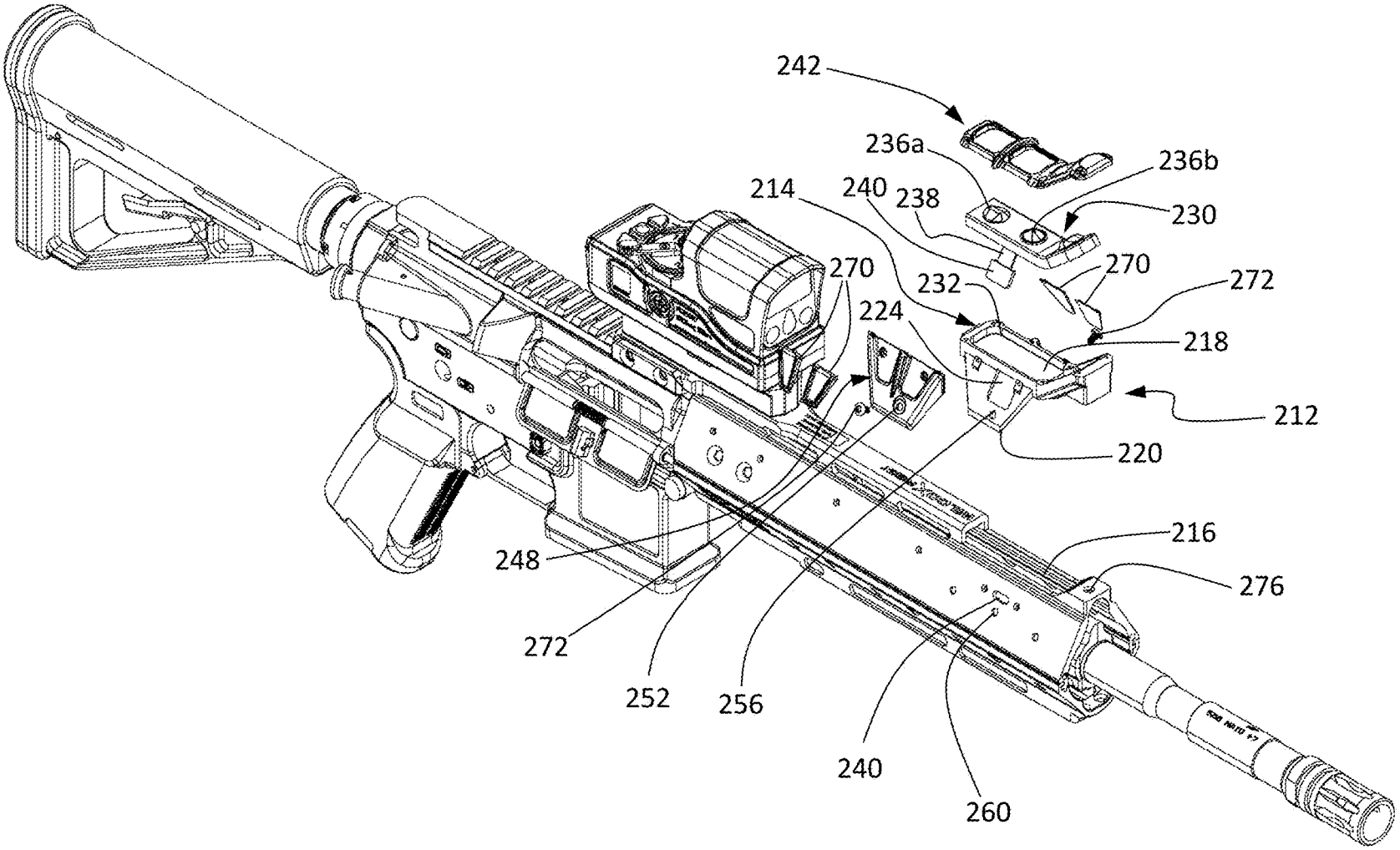
FIG. 14 is a second isometric view of the weapon with the riser assembly and keypad assembly appearing in FIG. 1 with the keypad assembly in exploded view.
Figure 15:
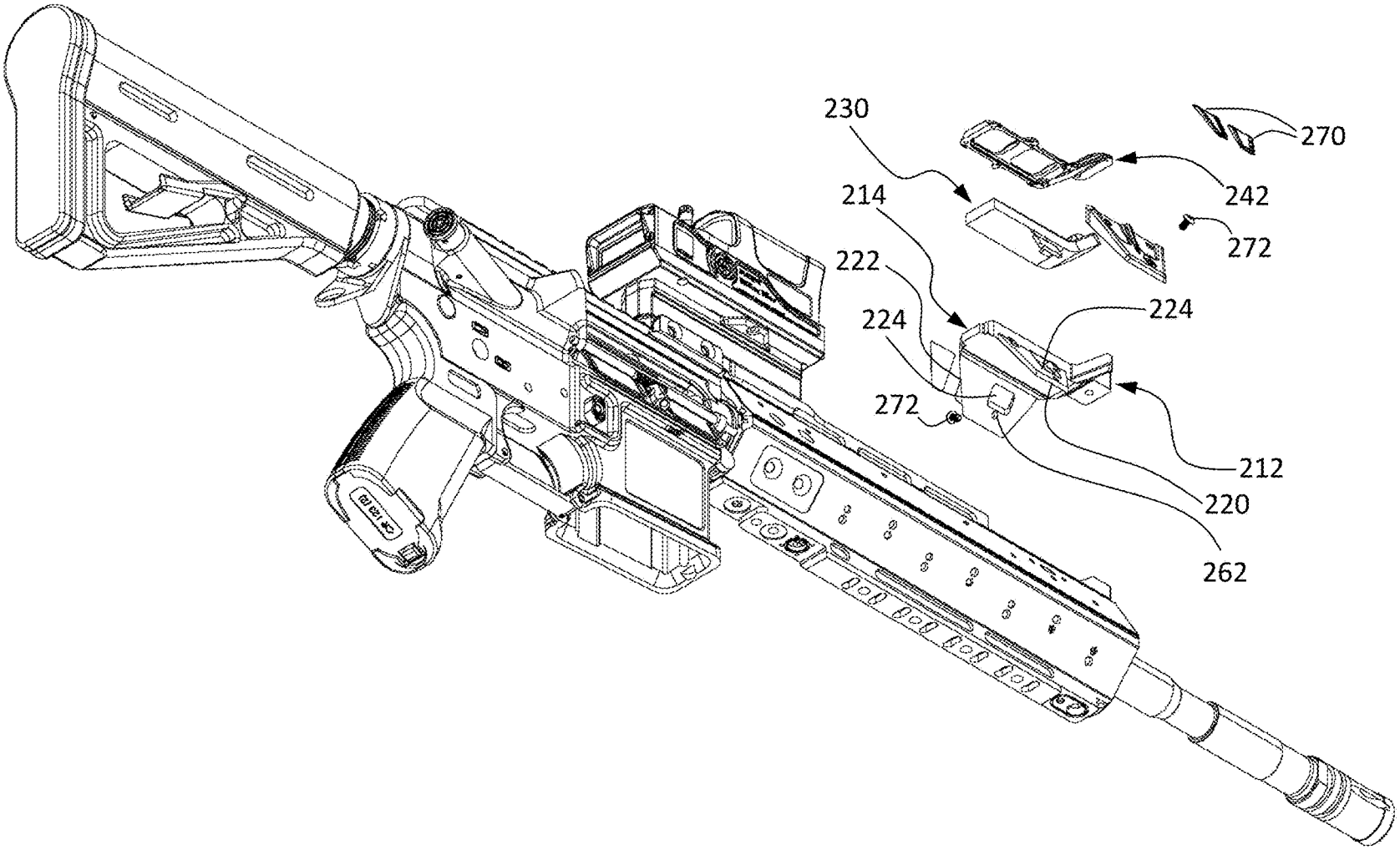
FIG. 15 is a third isometric view of the weapon with the riser assembly and keypad assembly appearing in FIG. 1 with the keypad assembly in exploded view.
Figure 16:
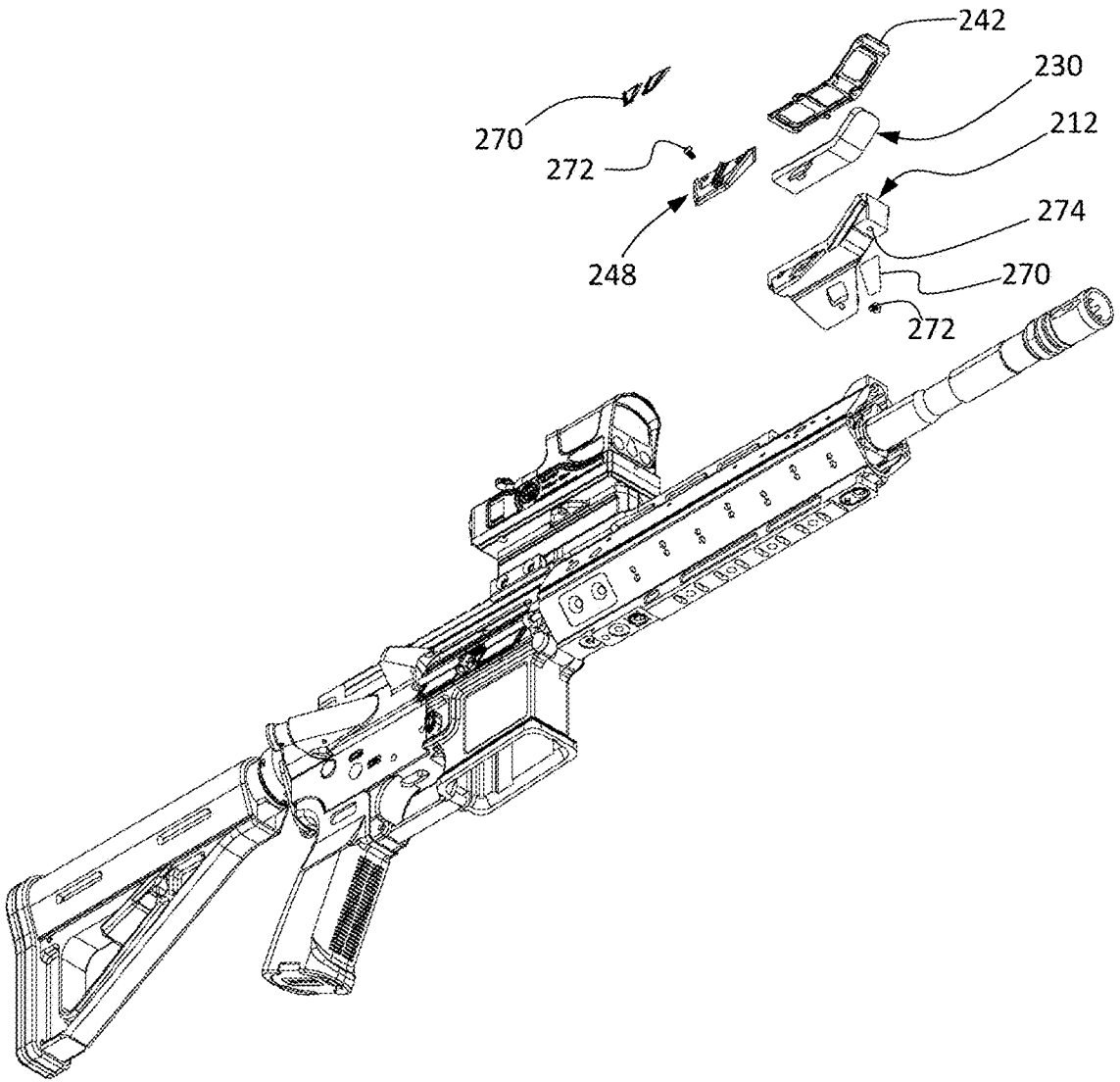
FIG. 16 is a fourth isometric view of the weapon with the riser assembly and keypad assembly appearing in FIG. 1 with the keypad assembly in exploded view.
Figure 17:
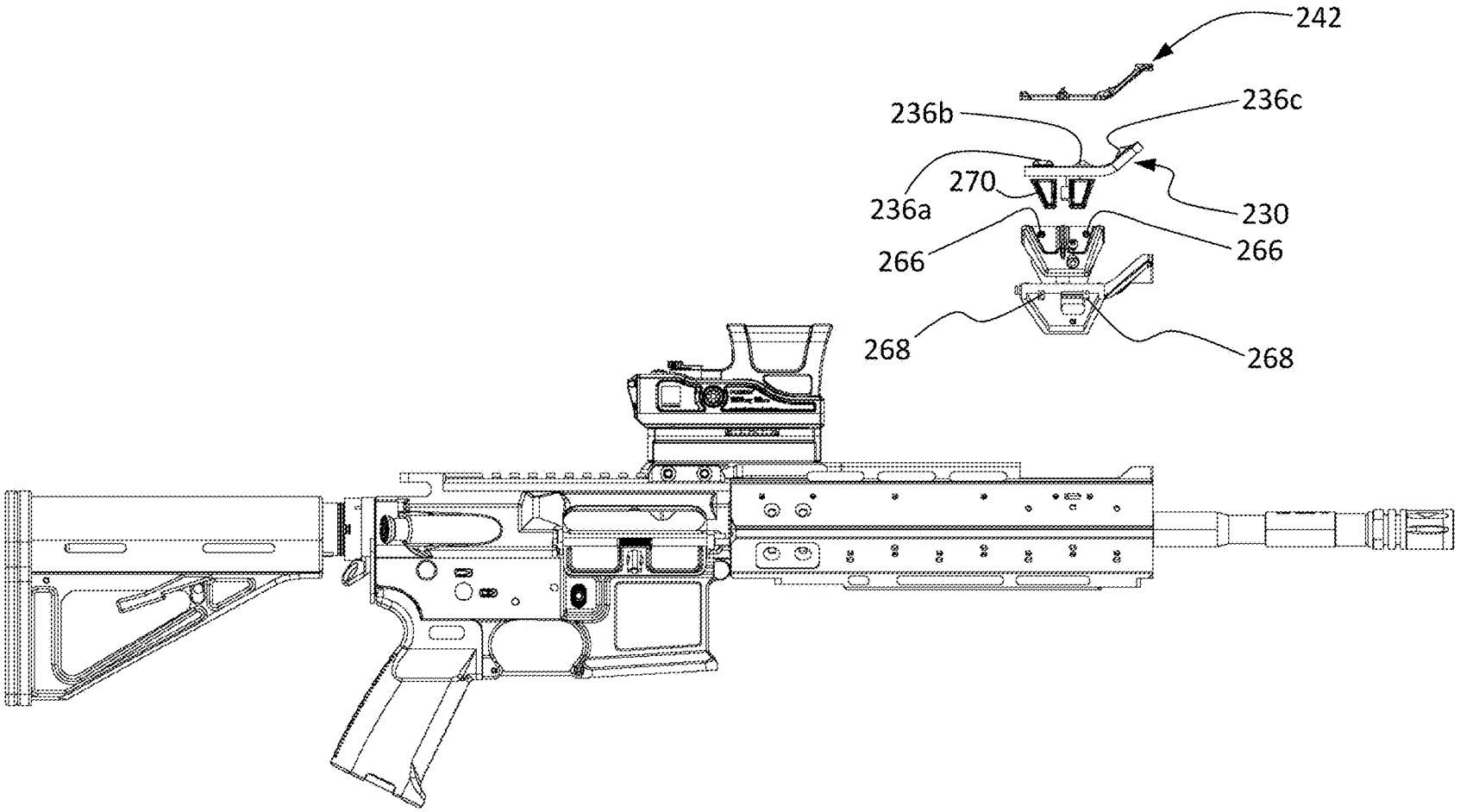
FIG. 17 is a side elevational view of the weapon with the riser assembly and keypad assembly appearing in FIG. 1 with the keypad assembly in exploded view.
Figure 18:
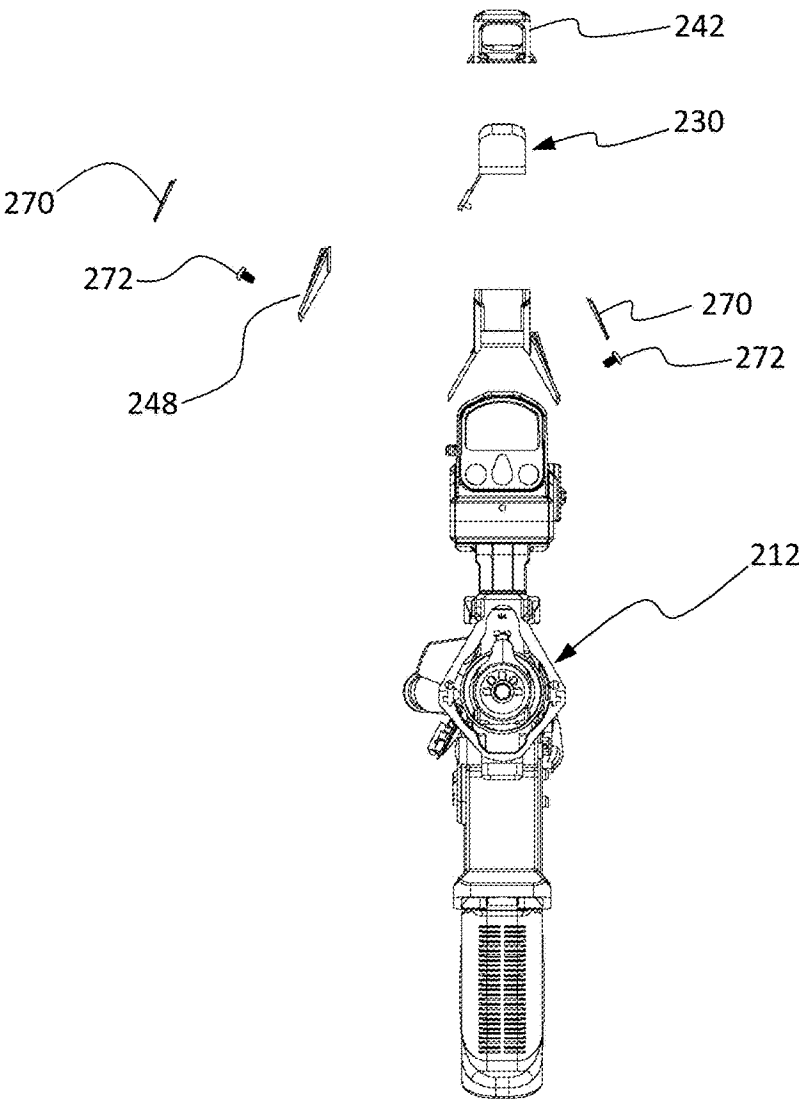
FIG. 18 is a front elevational view of the weapon with the riser assembly and keypad assembly appearing in FIG. 1 with the keypad assembly in exploded view.
Figure 19:
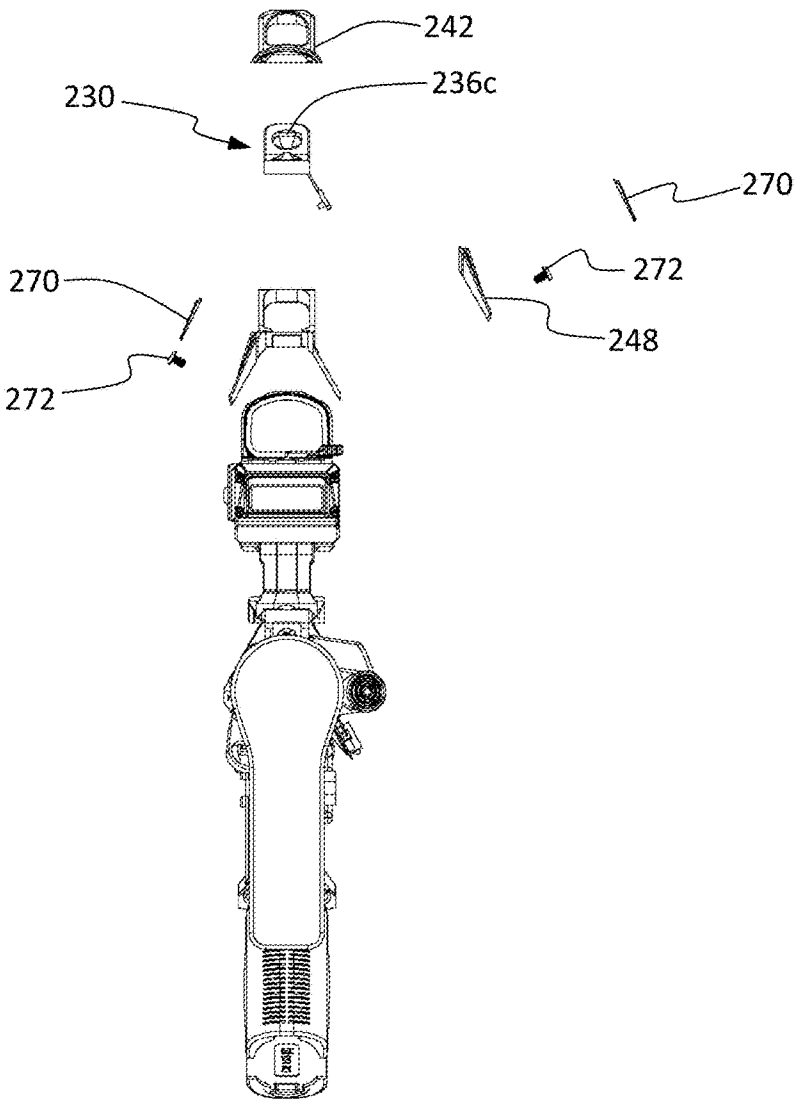
FIG. 19 is a rear elevational view of the weapon with the riser assembly and keypad assembly appearing in FIG. 1 with the keypad assembly in exploded view.

Referring now to the drawings, FIGS. 1-19, there appears a weapon 100 having an accessory device 104 mounted to a weapon accessory interface of the weapon 100. In embodiments, the weapon 100 is a firearm. In embodiments, the weapon 100 is a rifle. In the illustrated embodiment, the weapon 100 includes a buttstock 108, a receiver 112, and a barrel 116. In embodiments, a rail interface section 120 is disposed on the upper surface of the receiver 112. In embodiments, the rail interface section 120 is a Picatinny rail interface (e.g., MIL-STD-1913, STANAG 2324, or the like).

A handguard 124 surrounds the barrel 116. In embodiments, the handguard 124 includes accessory attachment features 128 such as M-LOK™ compatible slots configured to attach M-LOK™ compatible accessory devices. Intermediate the handguard 124 and the rail section 120 is a powered accessory mounting platform 130. The platform 130 is secured via a bracket 132 and threaded fasteners (not shown).

The platform 130 includes an electrical connector 136 which is electrically coupled to circuitry 146 within the handguard 124, which may include power supply channels within the weapon handguard 124, data and control signal channels within the handguard 124, or both. A riser assembly 140 is secured to the mounting platform 130. The riser assembly 140 includes a base housing 144 defining an interior compartment 148 and a housing cover 150. In embodiments, the housing cover includes clearance openings 151 configured to receive a threaded fastener (not shown) for threadably engaging complementary openings 101 on the lower surface of the accessory device 104.

The base housing 144 includes a protrusion 145 configured to engage with a complementary recess 135 formed on the powered accessory mounting platform 130. The protrusion 145 and recess 135 are configured to interlock, providing a secure engagement that resists shifting or movement of the riser assembly 140 during use. This interlocking engagement is configured to resist movement of the riser assembly 140 in relation to the platform 130 when subjected to recoil forces encountered during weapon firing.

Likewise, the base of the accessory device 104 includes a protrusion 105 configured to engage with a complementary recess 155 formed on the housing cover 150. The protrusion 105 and recess 155 are configured to interlock, providing a secure engagement that resists shifting or movement of the accessory device 104 during use. This interlocking engagement is configured to resist movement of the accessory device 104 in relation to the riser assembly 140 when subjected to recoil forces encountered during weapon firing.

A circuit assembly 152 comprising a flexible circuit substrate 156 is disposed within the interior compartment 148. The substrate 156 is elongated and folded back along itself. The riser base housing 140 and cover 150 may be formed of any suitable material, including but not limited to metal, polymer, composite material, or any combination thereof. The riser base housing 140 and cover 150 may be manufactured by any suitable method, as known in the art, including but not limited to molding, machining, additive manufacturing (e.g., 3D printing), or any combination thereof. The flexible circuit substrate may be formed of a polymer film having conductive elements or tracings formed thereon.

The riser assembly 140 is secured to the platform 130 via threaded fasteners (not shown) that pass through clearance openings 160 in the cover 150 and clearance openings 164 in the base housing 144 and threadably engage threaded openings 168 in the platform 130. Another threaded fastener (not shown) passes through a clearance opening 170 in the cover 150, aligned openings 154 in the circuit substrate 156 and a clearance opening 174 in an upstanding boss 176 and threadably engages a threaded opening 178 in the platform 130. The cover 150 is secured to the housing base 144 via threaded fasteners (not shown) that pass through clearance openings 158 and engage threaded openings 162 in the housing base 144.

An electrical connector 180 is coupled to a first end of the substrate 156 and is configured to detachably engage the connector 136 through an opening 184 disposed in the housing base 144. The first end of the connector may be secured within the compartment 148 via threaded fasteners (not shown). A second end of the substrate 156 opposite the first end includes an electrical connector 190 which is configured to detachably engage an electrical connector 192 disposed on a bottom surface 196 of the attached accessory device 104. The connector 190 passes through an aligned opening 204 in the housing cover 150. A sealing ring or gasket 208, which may be formed of a suitable elastomeric material, may be disposed intermediate the base housing 144 and the housing cover 150 to seal against external moisture and contamination entering the interior compartment 148.

The riser assembly 140 has a height H and is configured to elevate the accessory device 104 to a desired height in relation to the handguard 124. In embodiments, the riser height dimension H is a predetermined elevation relative to the weapon 100. In embodiments, the height H may be selected to elevate the optical axis of the accessory device 104 above the hand of a user gripping the handguard 124 of the weapon 100. The height H may be selected to ensure that the field of view of the accessory device 104 is unobstructed by the user's hand or other firearm components during operation.

The riser assembly 140 can advantageously be used to elevate the weapon accessory device 104 to a more comfortable and ergonomic shooting position, e.g., to help align the user's eye with the sight during the aiming process. Additionally, the riser assembly 140 can provide clearance for other attachments. In embodiments, the riser assembly 140 can be used to provide a height that ensures a proper sight picture, particularly when using a low-profile or flat top rifles or where the accessory rail otherwise sits close to the barrel. In embodiments, the riser assembly 140 can be used to provide a height so that the optical axis of the accessory device is at a sufficient height to provide clearance to permit the shooter to engage the barrel/handguard using an overhand grip. In embodiments, the riser assembly 140 herein is dimensioned and configured to align an optical axis of the accessory device 104 with the optical axis of another optical device (not shown) such as an optical scope or optical magnifier. For example, in certain embodiments, the accessory device 104 is a fire control system having an integral reflex or red dot sight component 142 which can advantageously be used in conjunction with an optical magnifier (e.g., a 4× magnifier). In certain embodiments, the riser assembly 140 is configured to provide for the proper elevation and alignment of the riser assembly 140 in relation to another optical device on the weapon 100.

A keypad assembly 210 is disposed at the fore end portion of the handguard 124. The keypad assembly includes a mounting frame 212 which is disposed over an opening 216 in the upper surface at the fore end portion of the handguard 124. The frame 212 includes a central frame portion 214 having a central opening or recess 218 and a pair of opposing first and second lateral bracket legs 220, 222, respectively. The first lateral bracket leg 220 includes an opening 224. The central frame portion 214 includes the opening or recess 218 which is vertically aligned with the opening 216 in the handguard 124.

A keypad switch subassembly 230 is disposed on the central frame portion 214 over the opening or recess 218. A sealing ring or gasket 232, which may be formed of a suitable elastomeric material, may be provided between the keypad switch subassembly 230 and the central frame portion 214 to prevent ingress of moisture and other external contamination. In the illustrated embodiment, the keypad switch subassembly 230 includes three user-depressible switches 236*a*, 236*b*, and 236*c*. It will be recognized that other numbers of switches are contemplated. In certain embodiments, the switches 236*a*, 236*b*, and 236*c* are membrane switches. In certain embodiments, the switches 236*a*, 236*b*, and 236*c* are dome switches, e.g., which use actuators formed of rubber or other resilient elastomeric material. Other button or key switch types are also contemplated. A key switch cover frame 242 is disposed over the keypad switch subassembly 230.

In embodiments, the switches 236*a*, 236*b*, and 236*c* include key caps or surfaces that have distinctively shaped and/or contoured surfaces to provide tactile feedback to allow a user to distinguish between the keys by touch.

The keypad switch subassembly 230 includes a flexible electrical interconnect 238, such as a flex circuit, ribbon cable, or the like, terminating in an electrical connector 240. The connector 240 in turn, engages a connector 244 disposed on the handguard 124, via the opening 224 in the first lateral bracket leg 220. A trim panel 248 is disposed over the first lateral bracket leg 220. In embodiments, the second lateral leg bracket 222 has the same construction as the first bracket leg 220, including a removable trim panel, but in a mirror-reversed orientation.

The mounting frame 212, key switch cover frame 242, trim panel 248, and so forth may be formed of any suitable material, including but not limited to metal, polymer, composite material, or any combination thereof. The mounting frame 212, key switch cover frame 242, trim panel 248, and so forth may be manufactured by any suitable method, as known in the art, including but not limited to molding, machining, additive manufacturing (e.g., 3D printing), or any combination thereof. The flexible circuit substrate 238 may be formed of a polymer film having conductive elements or tracings formed thereon.

The keypad assembly 210 is operative to remotely control operation of the accessory device 104. The connector 244 is electrically coupled to the circuitry 146 within the handguard which, in turn, is electrically coupled to the connector 136 on the accessory mounting platform 130.

In embodiments, switches 236*a*-236*c* are configured to actuate the accessory device 104. In embodiments, the switches 236*a*-236*c* may be used to select functions or modes or otherwise control operation of the accessory device 104, e.g., through different functions assigned to each switches 236*a*-236*c*. In certain embodiments, multiple functions are obtained via button presses of various lengths of time, e.g., quick press, medium press, long press, etc., button press sequences, e.g., single press, double press, triple press, etc., or combinations thereof.

In certain embodiments, the switches 236*a*-236*b* are configured to actuate or otherwise control operation of a selected laser emitter 254*a*, 254*b*, 254*c*, e.g., by accessing functions such as laser selection, laser intensity, or other modes, such as laser momentary on switch, laser on-off toggle switch., e.g., through different functions assigned to each distinctive button or by the number of presses, hold time of a button press, and/or button press sequence.

In certain embodiments, the switches 236*a* and 236*b* are configured to actuate or otherwise control operation of a second accessory device (not shown), such as an attached flashlight, e.g., by accessing functions such as brightness, strobe, SOS, or other modes, etc., e.g., through different functions assigned to each distinctive button or by the number of presses, hold time of a button press, and/or button press sequence.

The keypad subassembly 210 is secured to the fore end portion of the handguard 124 via a threaded fastener 272 which passes through a clearance opening 252 in the trim panel 248 and a clearance opening 256 in the first lateral bracket leg 220 and threadably engages a threaded opening 260 in the handguard 124. Likewise, a threaded fastener 272 passes through a clearance opening 262 in the second lateral bracket leg 222 and threadably engages a threaded opening 260 in the handguard 124. Threaded fasteners (not shown) also pass through clearance openings 266 in the trim panel 248 and threadably engage threaded openings 268 in the central frame portion 214. In embodiments, the trim panel 248 and the second bracket leg 222 each have inserts 270 disposed thereon. In embodiments, the inserts 270 are configured for enhanced ergonomics. In embodiments, the inserts 270 are configured for enhanced grip. In embodiments, the inserts 270 are formed of a material such as silicone rubber or other elastomer which has anti-slip properties. In embodiments, the inserts 270 have a textured surface for enhanced grip. A threaded fastener (not shown) may also be provided to engage an opening 274 at the distal end of the mounting frame 212 and an opening 276 at the distal end of the handguard 124.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A weapon attachment riser system for a weapon, comprising:

a riser assembly including a base housing defining an interior compartment and a housing cover secured to the base housing;

the base housing configured to be detachably secured to a powered weapon accessory interface on the weapon and the housing cover configured to be detachably secured to an accessory device;

a circuit assembly comprising a flexible circuit substrate disposed within the interior compartment;

the circuit assembly including a first electrical connector configured to detachably engage a complementary weapon rail interface port on the powered weapon accessory interface through an aligned opening in the housing base and a second electrical connector configured to detachably engage a complementary accessory interface port on the accessory device through an aligned opening in the housing cover.

2. The weapon attachment riser system of claim 1, wherein the first electrical connector is disposed proximate a first end of the flexible circuit substrate and the second electrical connector is disposed proximate a second end of the flexible circuit substrate.

3. The weapon attachment riser system of claim 2, wherein the flexible circuit substrate is elongated and folded back along itself.

4. The weapon attachment riser system of claim 2, wherein the flexible circuit substrate includes first and second apertures which are axially aligned when the flexible circuit substrate is elongated and folded back along itself, and wherein the base housing comprises a mounting boss passing through the first and second apertures configured to receive a threaded fastener extending between the base housing and the housing cover.

5. The weapon attachment riser system of claim 1, wherein the riser assembly has a height and is configured to elevate the accessory device to a desired height in relation to a surface of the weapon.

6. The weapon attachment riser system of claim 5, wherein the height is configured to align an optical axis of the accessory device with an optical axis of an optical device.

7. The weapon attachment riser system of claim 1, in combination with the weapon.

8. The weapon attachment riser system of claim 7, wherein the weapon is a rifle.

9. The weapon attachment riser system of claim 1, in combination with the accessory device.

10. The weapon attachment riser system of claim 9, wherein the accessory device is a reflex sight.

11. The weapon attachment riser system of claim 1, further comprising:

a remote keypad assembly configured to be operably coupled to the powered weapon accessory interface, the remote keypad being configured to control operation of the accessory device.

12. The weapon attachment riser system of claim 11, wherein the remote keypad assembly is configured to be disposed at a fore end portion of a handguard associated with the weapon.

13. The weapon attachment riser system of claim 11, wherein the remote keypad assembly comprises:

a mounting frame configured to be disposed over an opening in a handguard associated with the weapon, the mounting frame including a central frame portion having a central opening and a pair of opposing first and second lateral bracket legs;

the first lateral bracket leg including an opening;

the central frame portion including said central opening, which is configured to be vertically aligned with the opening in the handguard;

a keypad switch subassembly disposed on the central frame portion over the central opening, the keypad switch subassembly comprising a plurality of user depressible switches; and a key switch cover frame disposed over the keypad switch subassembly.

14. The weapon attachment riser system of claim 13, wherein each of the plurality of user depressible switches includes key surfaces with distinctively shaped and/or contoured surfaces configured to provide tactile feedback to allow a user to distinguish between the keys by touch.

15. The weapon attachment riser system of claim 13, wherein the keypad switch subassembly includes a flexible interconnect having an electrical connector received within the first lateral bracket leg and configured to engage a complementary connector disposed on the handguard.

16. The weapon attachment riser system of claim 13, in combination with the handguard.

17. The weapon attachment riser system of claim 16, wherein the remote keypad assembly is integral to the handguard.

* * * * *